United States Patent [19]

Fletcher et al.

[11] 3,989,136

[45] Nov. 2, 1976

[54] GUIDE FOR A TYPEWRITER

[76] Inventors: James C. Fletcher, Administrator of the National Aeronautics and Space Administration, with respect to an invention of; Robert D. Dubois; George T. Pinson, both of Huntsville, Ala.

[22] Filed: Aug. 9, 1973

[21] Appl. No.: 387,094

[52] U.S. Cl. ..... 197/188; 197/190

[51] Int. Cl.[2] ..... B47J 29/42

[58] Field of Search ..... 197/187, 188, 189, 190, 197/180, 181

[56] References Cited

UNITED STATES PATENTS

| | | | |
|---|---|---|---|
| 627,180 | 6/1899 | Force | 197/190 |
| 893,256 | 7/1908 | May | 197/190 |
| 895,891 | 8/1908 | Persson | 197/190 |
| 2,558,147 | 6/1951 | Nicely | 197/190 |
| 2,930,471 | 3/1960 | Roggenstein | 197/190 |

FOREIGN PATENTS OR APPLICATIONS

| | | | |
|---|---|---|---|
| 978,695 | 12/1964 | United Kingdom | 197/190 |

*Primary Examiner*—Edward M. Coven
*Attorney, Agent, or Firm*—L. D. Wofford, Jr.; John R. Manning

[57] ABSTRACT

An improved guide for use in aligning within a typewriter a sheet of paper preparatory to an application of typed indicia to a space thereof. The guide is characterized by a bellcrank lever, pivotally supported by a swatch of flexible material adhesively secured to a typewriter adjacent the V-guides thereof, and supporting at its distal end a space sight including a pair of orthogonally related legs positionable into and out of the path of a type slug for framing a targeted space to be struck by a slug in response to a depression of a selected key.

2 Claims, 3 Drawing Figures

GUIDE FOR A TYPEWRITER

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

BACKGROUND OF THE INVENTION

The invention relates to accessories for typewriters, and more particularly to an improved guide for use in aligning a sheet of paper preparatory to an application of typed indicia to selected spaces thereof.

In performing typing operations of various sorts, errors often are committed. Frequently, such errors are discovered only upon proofreading after the document has been disassociated from the typewriter employed in its preparation. As a result, the mistake is erased, masking fluid or the like applied, and the document, or sheet of paper, reinserted in the typewriter for correction. Such an operation requires that the space or spaces to receive correction, by application of indicia, be precisely registered with the target area for the type slugs, in order to prevent the correction from becoming quite apparent, even upon a casual perusal.

The prior art is, of course, replete with guides for correcting typographical errors and the like. Such guides are typified by the guide disclosed in U.S. Pat. No. 2,558,147, which issued by G. L. Nicely, June 26, 1951. The device shown in that patent includes an aligning plate pivotally mounted on a line guide having formed therein a plurality of aligned apertures. The plate is so positioned that an aperture may be positioned immediately above a target area for a type slug so that a slug will imprint a character in selected spaces, in response to a manipulation of a selected key, provided the spaces have first been aligned with the aperture.

Of course, one of the unsolved problems encountered in employing devices of the type disclosed by the patent to Nicely is that the device must be affixed permanently to the typewriter, with precision, at its point of manufacture. Consequently, such devices tend to be relatively expensive, and their use is severely impeded. Therefore, as a practical matter, available guides simply have not been accepted for use by typists and the like.

Through the instant invention, however, the aforementioned disadvantages have been overcome.

It is therefore the general purpose of the instant invention to provide a practical, economic, and readily employable guide which is particularly suited to be adhesively secured to cardholders of typewriters and readily employed by a typist in correcting typographical errors.

OBJECTS AND SUMMARY OF THE INVENTION

It is therefore an object of the instant invention to provide in combination with the typewriter a guide for use in aligning a sheet of paper preparatory to applications thereto of typed indicia.

It is another object to provide a guide which can be applied to a cardholder of a typewriter at a point of use.

It is another object to provide a simplified and economic guide which can readily be employed by a typist in correcting typographical errors.

It is another object to provide an improved, economic and practical guide, having a target sight, which can be affixed by a typist, to a cardholder of a typewriter and utilized in designating the precise target area for type slugs whereby correction of typographical errors readily may be corrected.

These and other objects and advantages are achieved through the use of a guide pivotally supported by a base formed of a flexible material and adapted to be adhesively secured to a cardholder, including a bellcrank lever formed of a thin wire and supported by said swatch, and having a sight provided at one end of the bellcrank lever defined by a pair of orthogonally related legs, whereby the sight is supported for pivotal oscillation into and out of operative registry with the target area for the type slugs, as will hereinafter become more readily apparent by reference to the following description and claims in the light of the accompanying drawings.

DESCRIPTION OF THE PREFERRED EMBODIMENT

Figure 1:
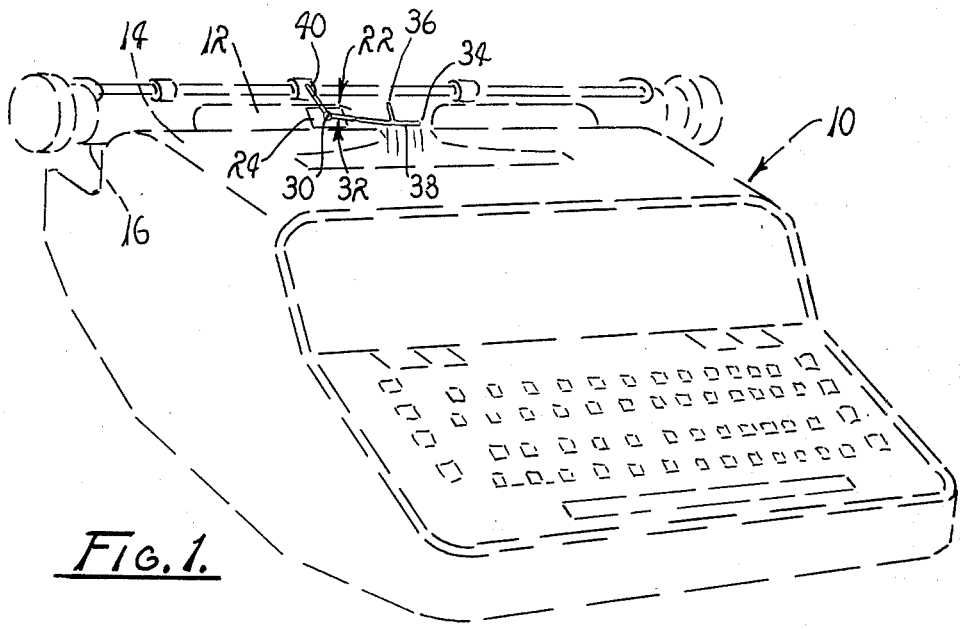
FIG. 1 is a perspective view of a typewriter having a cardholder upon which is mounted a guide embodying the principles of the instant invention.

Referring now more specifically to the drawings, wherein like reference characters designate like or corresponding parts throughout the several views, there is shown in FIG. 1 a typewriter 10, equipped with an embodiment of the instant invention.

The typewriter, as illustrated, includes a cardholder 12 of known design mounted on a case 14 for the typewriter 10. It is to be understood that the typewriter 10 forms no specific part of the instant invention, therefore, a detailed description thereof is omitted in the interest of brevity. However, it also is to be understood that the typewriter 10 is of a design which includes a platen 16 provided for supporting a sheet of paper 18. As keys, not designated, are struck, type slugs, not shown, are advanced for applying indicia to the paper 18. As is common practice, the typewriter 10 is provided with "V-guides" 20 between which typebars are guided as the type slugs are advanced into engagement with the paper 18 supported by the platen 16.

The cardholder 12 preferably is of a transparent material, such as, for example, synthetic resin. The holder 12 is curved about a longitudinal axis in a manner such that an arcuate cross-sectional configuration is imparted to the holder having a radius similar to the radius of the platen 16. In practice, the guide 22, which embodies the principles of the instant invention, includes a base formed of a flexible swatch 24 having a suitable layer 26 of adhesive deposited on the backing thereof so that the swatch may be readily adhered to the face of the cardholder 12. As a practical matter, the swatch is formed from heavy construction paper and the layer of adhesive is protected by a removeable backing strip 28 applied thereto in any suitable manner.

Extended through the swatch 24 there is a pivot pin 30 upon which is mounted a bellcrank lever 32. The pivot pin 30 serves as a fulcrum for the bellcrank lever 32 so that the lever may be pivotally oscillated about the pivot pin. The particular manner in which the pivot pin is fabricated forms no part of the instant invention. However, and as a practical matter, the pin 30 is provided as a rivet extended through the construction paper.

Figure 2:
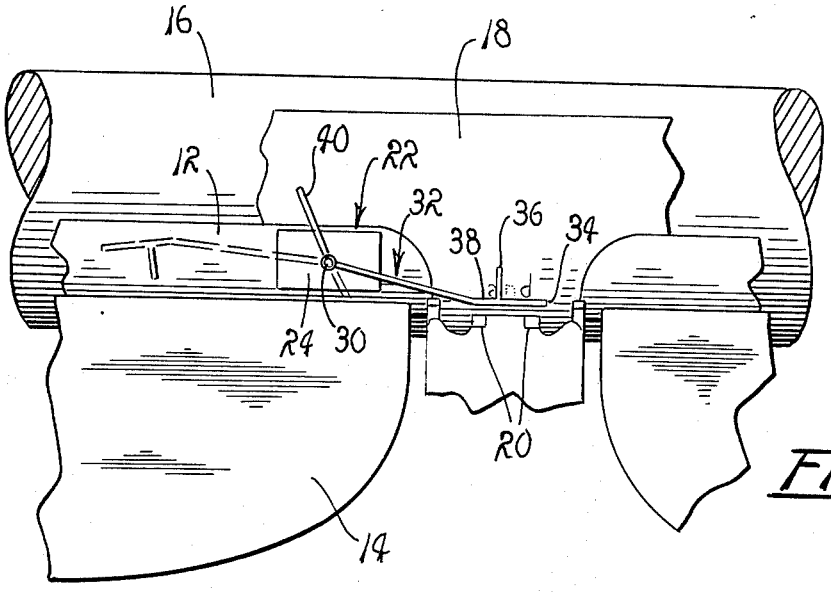
FIG. 2 is a fragmented perspective view, on an enlarged scale, of the cardholder and guide depicted in FIG. 1.
Figure 3:
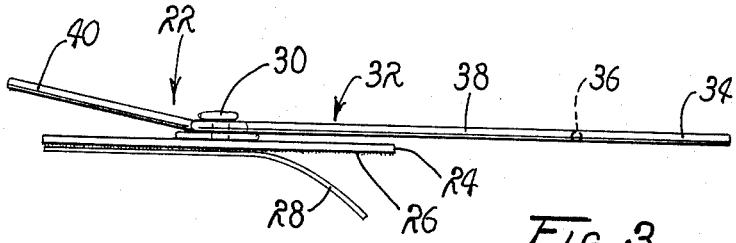
FIG. 3 is a top plan view of the guide shown in FIGS. 1 and 2.

The guide 22 also includes a sight 34 formed at one end of the bellcrank lever 32. The sight is formed of a pair of normally related legs 36 and 38, as best shown in FIG. 2. The opposite end of the bellcrank lever 32 includes a thumb lever 40 which, when depressed, imparts oscillatory motion to the bellcrank 32 about the pivot pin 30. Thus, it is to be understood that upon being sufficiently manipulated the thumb lever 40 serves to impart pivotal rotation to the bellcrank 32, through a distance such that the sight 34 is caused to assume an alternate position.

The guide 22 is supplied to a typist in bulk form. A typist, upon a removal of the backing strip 28, affixes the guide to a typewriter simply by bringing the layer of adhesive 26 into contiguous engagement with the surface of the cardholder 12 at a point such that the sight 34 may assume a position of registry with the target area of the type slugs, normally found immediately above the V-guides of the typewriter. Once mounted in this fashion, the typist need merely manipulate the thumb lever 40 for displacing the sight 34 into and out of operative position.

OPERATION

It is believed that in view of the foregoing description, the operation of the device will readily be understood and it will be briefly reviewed at this point.

In the event an error is discovered in a typewritten sheet, a typist merely erases that letter or letters and reinserts the sheet into the typewriter to be employed in correcting the error. The guide 22 now is so manipulated that the sight 34 is caused to register with the target area of the type slugs. The space from which the typed indicia was erased is now registered with the target area, the leg 36 of the sight 34 being employed in effecting horizontal positioning and the leg 38 thereof being employed in effecting vertical positioning of the sheet. Once the sheet of paper has been properly positioned, employing the sight 34 and the guide 22, the guide is rotated, by depressing the thumb lever 40, to its inoperative or stowed position. Hence, as a key is struck, a typebar is caused to advance between the V-guides 20 and the slug affixed to the distal end thereof is caused to strike its target area and apply indicia to the precise space registered with the target area.

In view of the foregoing, it should readily be apparent that through the use of the instant invention, it is possible to accurately register spaces to receive indicia with target areas of type slugs. This, of course, conserves both time and money and ultimately results in a neat and legible document.

Although the invention has been herein shown and described in what is conceived to be the most practical and preferred embodiment, it is recognized that departures may be made therefrom within the scope of the invention, which is not to be limited to the illustrative details disclosed.

We claim:

1. An improved guide for use in aligning a sheet of paper preparatory to an application on a target area thereof of typed indicia by a type slug of a typewriter comprising:

a guide base including a swatch of flexible material having a layer of adhesive affixed to one side thereof;

said guide comprising an elongated relatively fine wire pivotally supported by said swatch;

means defining a space sight near one end of said wire including a pair of coplaner orthogonally related legs, and means defining a thumb actuator portion at the end portion of said wire remote from said sight, said pivotal support being located between said thumb actuator portion and said space sight thereby forming a bellcrank lever;

the pivotal axis of said pivotal support being normal to the plane of said swatch and the plane of said legs;

said guide being combined with a typewriter having a cardholder;

said swatch of flexible material being adhesively secured to said cardholder whereby said space sight is positionable into and out of registry with the target area of type slugs of said typewriter;

the plane defined by said coplaner legs being substantially parallel to the plane of said cardholder.

2. The guide of claim 1 wherein said swatch is made of construction paper.

* * * * *